US006523469B2

(12) United States Patent
Bayer et al.

(10) Patent No.: US 6,523,469 B2
(45) Date of Patent: Feb. 25, 2003

(54) DEVICE FOR METERING AND EQUALIZING AN INK LAYER ON THE SURFACE OF A PRINTING MACHINE ROLLER

(75) Inventors: Wolfgang Bayer, Meitingen/Erlingen (DE); Andreas Berchtold, Wssling/Obb (DE); Thomas Böck, Neusäss (DE); Robert Konrad, Wiesenbach (DE); Harald Lesti, Wiesenbach (DE); Xaver Bachmeir, Affing-Haunswies (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 1 day.

(21) Appl. No.: 09/877,432

(22) Filed: Jun. 8, 2001

(65) Prior Publication Data

US 2002/0005128 A1 Jan. 17, 2002

(30) Foreign Application Priority Data

Jun. 8, 2000 (DE) ..... 100 28 477

(51) Int. Cl.[7] ..... B41F 9/10; B41F 9/16; B41F 31/04; B41F 31/02

(52) U.S. Cl. ..... 101/350.6; 101/155; 101/157; 101/167; 101/169

(58) Field of Search ..... 101/350.6, 155, 101/167, 169, 366, 157

(56) References Cited

U.S. PATENT DOCUMENTS

| | | | | |
|---|---|---|---|---|
| 2,018,193 A | * | 10/1935 | Smith | 101/157 |
| 4,066,014 A | * | 1/1978 | van Haaften | 101/157 |
| 4,211,167 A | | 7/1980 | Corse | 101/148 |
| 4,787,314 A | | 11/1988 | Harada et al. | 101/425 |
| 5,012,737 A | | 5/1991 | Makino et al. | 101/350 |

FOREIGN PATENT DOCUMENTS

| | | | | |
|---|---|---|---|---|
| DE | 28 32 172 | | 3/1979 | |
| DE | 32 25 982 | | 2/1983 | |
| DE | 3608944 A | * | 10/1986 | B41F/7/26 |
| DE | 39 30 822 | | 4/1990 | |
| DE | 9320447 | | 8/1994 | |
| DE | 4339939 A1 | * | 6/1995 | B41F/31/02 |
| DE | 691 13 655 | | 5/1996 | |
| EP | 070 484 | | 1/1983 | |
| EP | 44 58 12 | | 9/1991 | |

* cited by examiner

*Primary Examiner*—Daniel J. Colilla
(74) *Attorney, Agent, or Firm*—Cohen, Pontani, Lieberman & Pavane

(57) ABSTRACT

A device for metering and equalizing an ink layer on the surface of a printing machine roller, in particular on the surface of an ink applicator roller in the inking unit of a printing machine, the surface being additionally wetted with dampening medium. The device contains at least two doctor blades which are arranged preferably at a short distance one behind the other in the direction of rotation of the roller and rest under pressure against the surface of the roller and of which a front doctor blade, with respect to the direction of rotation of the roller, has a doctor blade edge radius such that essentially only the dampening medium, but not the ink layer, can be wiped off from the surface of the roller by said front doctor blade, while a rear doctor blade, with respect to the direction of rotation of the roller, has, by comparison, a smaller doctor blade edge radius such that at least part of the ink layer which has remained on the surface of the roller can be wiped off.

11 Claims, 2 Drawing Sheets

DEVICE FOR METERING AND EQUALIZING AN INK LAYER ON THE SURFACE OF A PRINTING MACHINE ROLLER

BACKGROUND OF THE INVENTION

1. Field of the Invention

The invention relates to a device for metering and equalizing an ink layer on the surface of an ink applicator roller in the inking unit of a printing machine.

2. Description of the Related Art

Metering devices of this type, known, for example, from DE 32 25 982 A1, are used, in particular, for ink applicator rollers in inking units of offset printing machines, the surface of such an ink applicator roller usually being elastic, since the plate cylinders cooperating with the ink applicator roller has a hard surface. In order to set a thin and uniform ink-layer thickness on the ink applicator roller, it is necessary to remove part of the ink layer located on the roller surface, in order to restrict or completely prevent undesirable ghosting. When the image segments of the plate cylinder transfer ink directly onto paper, small paper fibres may adhere to the surface of the plate cylinder and are then transferred onto the ink applicator roller.

Tests were conducted in the past to use stripping blades as means for metering the printing ink on the surface of ink applicator rollers, but the soft elastic surface of these was sometimes damaged. On the other hand, particles transferred from the plate cylinder onto the ink applicator roller and, furthermore, also the dampening medium located on the ink applicator roller accumulate along that edge of the stripping blade which cooperates with the roller, and this may lead to the formation of undesirable stripes and streaks on the roller surface.

SUMMARY OF THE INVENTION

By contrast, the object on which the present invention is based is to provide a metering device of the type mentioned in the introduction, by means of which a uniform ink layer is achieved on the roller surface, without streaks and stripes being formed there.

When using a device having a front blunt doctor blade and a rear doctor blade, a splitting-off of dampening medium is first achieved with the front doctor blade, in which a large part of the disturbing dirt particles are picked up. Consequently, such particles cannot build up along the rear doctor blade. Dirt particles which have nevertheless passed the front doctor blade are transported away together with the ink wiped off by the rear doctor blade. These measures reliably prevent the formation of streaks and stripes. The rear doctor blade ensures, with its substantially smaller doctor blade edge radius, that the excess ink fraction is wiped off, leaving a residual ink layer of defined thickness and metering, with the result that a high degree of equalization of the residual ink layer can be achieved. The respective throw-on pressure of the two doctor blades onto the roller surface, said pressure depending inter alia on the printing parameters, such as, for example, the printing speed, must be set, in this case, in such a way that the effects described above can arise.

The return of wiped-off ink is normally carried out by means of a pump with a drive motor, this having an adverse effect on the space requirement of the inking unit and on the manufacturing costs.

By contrast, according to an embodiment of the invention, the metering device contains a chamber which is delimited in the circumferential direction of the roller by the front doctor blade and the rear doctor blade, in the radial direction of the roller by a chamber bottom and the roller surface and in the axial direction of the roller by two side walls, the ink wiped off by the downstream doctor blade being capable of being retained in the chamber and, generating excess pressure there, of being discharged outwards via one or more chamber orifices. Due to the excess pressure in the chamber, the ink can be led away from the roller surface, without additional energy being expended. Thus, since the components necessary for a pump arrangement become superfluous, a space-saving and cost-effective solution, which is also less susceptible to faults, is obtained.

With the given geometry, surface quality and material of the doctor blade and roller and, in particular, a given circumferential speed of the roller, the ink-layer thickness is generally set as a function of the force with which the doctor blade is pressed onto the roller surface.

According to a further embodiment, however, the chamber is connected to a pressure source, preferably via the chamber orifices which are formed by passage bores in the chamber bottom, in order to produce a residual ink layer of specific thickness as a function of the pressure prevailing in each case in the chamber. It is thereby possible to control the layer thickness in a simple way by a defined pressure being set in the chamber, without the force with which the doctor blade is pressed on the roller surface having to be changed.

According to another embodiment of the invention, the metering device comprises a duct which extends preferably parallel to and at a radial distance from the chamber and which forms a portion of an ink circuit in which pressurized ink can be conveyed, the duct being constantly connected to the chamber by means of the passage bores in the chamber bottom. The pressure prevailing in the duct and in the chamber is then capable of being controlled or regulated by means of a throttle which, as seen in the direction of flow, is preferably downstream of the duct and is of adjustable flow cross section. By means of such a controllable throttle in the return, a static pressure can be generated in the chamber, thus resulting in a uniform ink layer of defined thickness. When ink is fed at a regulated pressure to the chamber, ink can be applied directly to the roller by means of the metering device, so that an extremely short inking unit with a short setting-up time and with high dynamics is obtained.

According to a further embodiment, the front and/or the rear doctor blade is provided with an ink-repelling coating or with a combination of an ink-repelling and an ink-friendly coating, with the result that a wetting of the doctor blade edges with ink is largely avoided. In addition to the beneficial prevention of the formation of stripes, the outlay in cleaning terms is thereby reduced.

The metering device preferably has a shorter length than the roller and is designed to be movable relative to the latter, preferably in the form of traversing, oscillating or swinging movements running parallel to the roller axis. This contributes to equalizing the ink in the longitudinal direction of the roller and to the avoidance of streaks.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
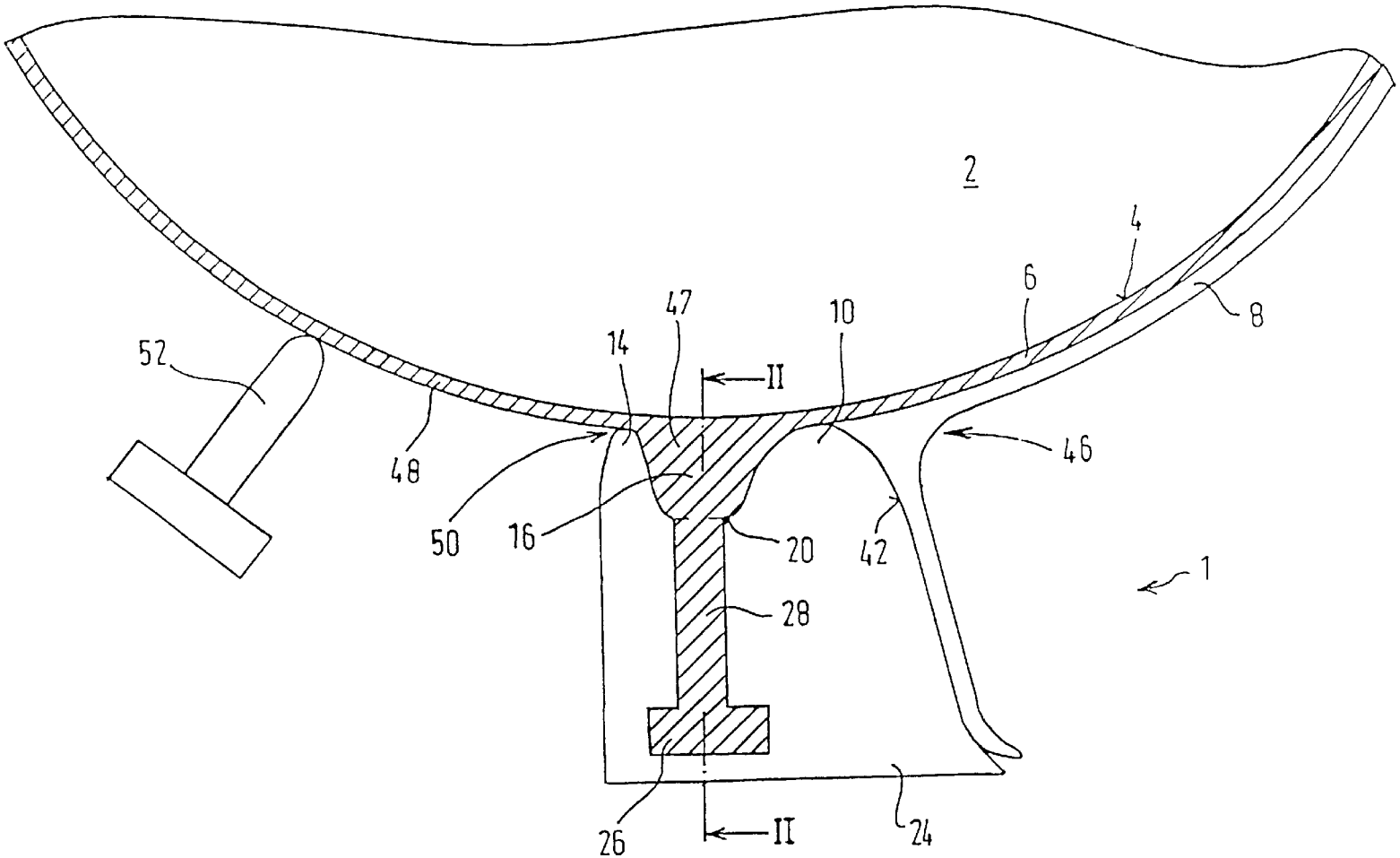
FIG. 1 shows a highly diagrammatic cross-sectional illustration of a metering device according to the invention in a preferred embodiment which is thrown onto a roller of a printing machine.

The preferred embodiment, designated as a whole by 1 in FIG. 1, of a metering device according to the invention is thrown onto a roller 2 in the inking unit of a printing machine. Lying on the roller surface 4 of the roller 2 are layers of ink 6, illustrated by hatching, and of dampening medium or water 8, which are shown as two layers separate from one another in FIG. 1 for the sake of clarity.

The metering device 1 contains preferably two doctor blades which are arranged one behind the other, as seen in the direction of rotation of the roller 2, and are thrown onto the roller surface 4 and of which a front doctor blade, referred to below as a closing doctor blade 10, is arranged at an entry of the roller 2 into the metering device 1. This closing doctor blade 10 is made blunt and has an edge radius of preferably 2 to 10 mm. Provided at a preferably short circumferential distance behind the closing doctor blade 10 is a rear doctor blade, referred to below as a working doctor blade 14, which is markedly more sharp-edged than the closing doctor blade 10 and has, for example, an edge radius of 0.1 to 0.8 mm.

Figure 2:
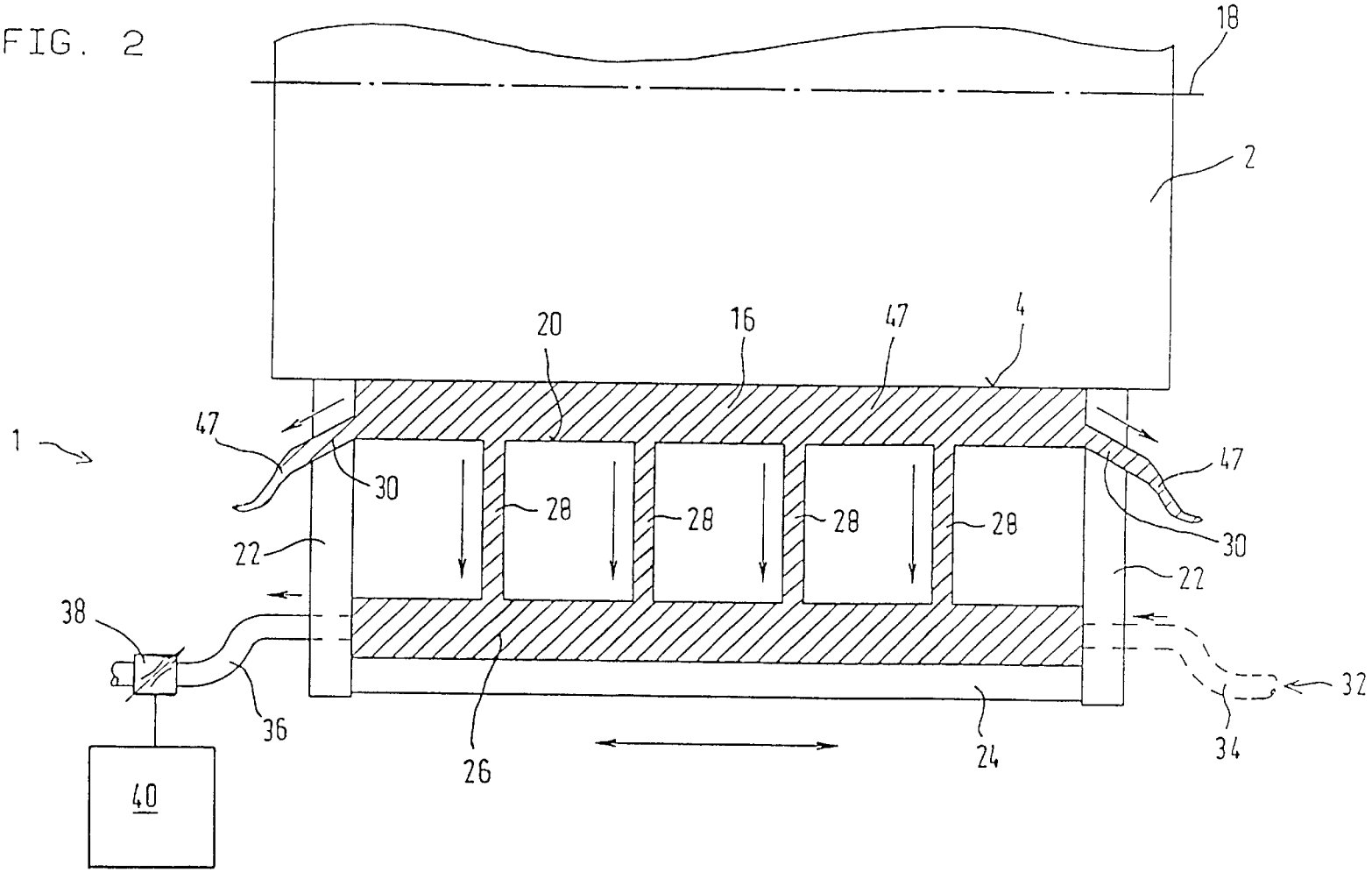
FIG. 2 shows a cross-sectional illustration along the line II—II of FIG. 1.

As seen in the circumferential direction of the roller 2, there is formed between the closing doctor blade 10 and the working doctor blade 14 a chamber 16, the longitudinal extent of which runs approximately parallel to the roller axis 18, as can best be seen from FIG. 2. The two doctor blades 10, 14, converging radially outwards, merge into a chamber bottom 20 approximately parallel to the roller surface 4, the chamber 16 being delimited radially inwards by the roller surface 4, as shown in FIG. 1.

As seen in the direction of the roller axis 18, the chamber 16 is delimited in each case by side walls 22 which are arranged in planes perpendicular to the roller axis 18 and, as seen in the radial direction, extend from a bottom 24 of the metering device 1 as far as the roller surface 4. Provided in the bottom 24 of the metering device 1 is a duct 26 which is connected to the chamber 16 by means of preferably radial passage bores 28 in the chamber bottom 20. Outflow bores 30 which connect the chamber 16 to the surroundings may additionally be provided in the side walls 22.

The duct 26 is, for example, part of a closed ink circuit 32 and is connected on the inflow side to a forward run 34 and on the outflow side to a return run 36 of the ink circuit 32, through which pressurized ink is pumped. Integrated into the return run 36 of the ink circuit 32 is an adjustable throttle 38 which can be activated by means of control signals from a control and regulating device 40, so that its flow cross section and consequently the ink mass flow passing through the throttle can be adjusted or regulated.

With the roller 2 rotating and having layers of ink 6 and dampening medium 8 which adhere to the roller surface 4, the metering device 1 according to the invention functions as follows:

At the blunt closing doctor blade 10, essentially only dampening medium 8 is wiped off from the roller surface 4 which, according to FIG. 1, runs off on an outer surface 42 of the closing doctor blade 10, said outer surface pointing away from the chamber 16, the dampening medium 8 being collected, for example, in a collecting container. The force with which the closing doctor blade 10 is pressed against the roller surface 4 or a front doctor blade clearance between them is, in this case, set in such a way that mainly the dampening medium 8 is wiped off. By contrast, essentially the entire ink 6 adhering to the roller surface 4 can pass through the front doctor blade clearance 46 present between the roller surface 4 and the closing doctor blade 10. Since the working doctor blade 14, due to its smaller edge radius, is made substantially more sharp-edged than the closing doctor blade 10, at least part 47 of the ink 8 adhering to the roller surface 4 is wiped off by the working doctor blade 14, so that a residual ink layer 48 remains adhering after passing through a rear doctor blade clearance 50 formed between the working doctor blade 14 and the roller surface 4.

Since the roller 2 rotates into the front doctor blade clearance 46 between the closing doctor blade 10 and the roller surface 4, this prevents the situation where the ink wiped off by the working doctor blade 14 and collecting in the chamber 16 emerges from the chamber 16 through the front doctor blade clearance 46. Furthermore, the sharp working doctor blade 14 ensures in the manner of a knife-edge seal that the chamber 16 is sealed off on the outflow side. The side walls 22 seal off the chamber 16 relative to the surroundings in the lateral direction.

Consequently, the ink 47 wiped off by the working doctor blade 14 accumulates in the chamber 16, with the result that excess pressure in relation to the surroundings builds up there in time. Due to the increase of pressure in the chamber 16, the wiped-off ink 47 is forced through the radial passage bores 28 into the bottom-side duct 26 of the metering device 1. Depending on the position of the throttle 38 in the return run 36 of the ink circuit 32, a counterpressure is generated in the duct 26 and also prevails in the chamber 16 through the passage bores. The lower this pressure is, that is to say the larger is the flow cross section of the throttle 38 set in each case, the more wiped-off ink 47 can be conveyed out of the chamber 16 through the passage bores 28 and the thinner is the remaining residual ink layer 48 on that portion of the roller surface 4 which has already passed the rear doctor blade clearance 50. If, on the other hand, a higher pressure is generated in the chamber 16 as a result of a corresponding throttle setting, the thickness of the residual ink layer 48 on the roller surface 4 increases. The thickness of the residual ink layer 48 on the roller 2 can thus be controlled or regulated highly accurately by means of appropriate activation of the throttle 38.

So that the layer thickness of the ink 6 on the roller surface 4 can be set by controlling or regulating the pressure of the ink in the chamber 16, as described, a pressing device for generating a defined pressing force of the doctor blades 10, 14 on the roller surface 4 may additionally be provided. This may be designed in such a way that an individual pressing force can be set for each doctor blade 10, 14.

In a preferred embodiment, the metering device 1 is movable relative to the roller 2 and can traverse or swing back and forth, for example, in a direction parallel to the roller axis 18 and along the surface 4 of the latter, as illustrated by the arrow in FIG. 2.

In order to prevent stripes from being formed on the roller surface 4 on the outflow side due to ink adhering to the doctor blades 10, 14, both doctor blades 10, 14 or else only one of the two doctor blades, preferably the working doctor blade 14, may be provided with an ink-repelling coating. A combination of ink-friendly and ink-repelling coatings may also prevent the doctor blades 10, 14 from being wetted with ink. In addition, spreading doctor blades 52 located downstream of the two doctor blades 10, 14, as seen in the direction of rotation of the roller, may be provided, in order to smooth the residual ink layer 48 running out. This effect may be assisted by movements of the spreading doctor blade 52, for example by traversing or swinging in relation to the roller surface 4.

According to a further embodiment, the metering device 1 may also have more than two doctor blades 10, 14 which are arranged one behind the other, as seen in the circumferential direction of the roller 2, and which comprise at least one closing doctor blade 10 and one working doctor blade 14, a chamber 16 being formed in each case between two such doctor blades. As a result of this measure, the desired ink layer thickness is produced in steps, so that high pressure gradients at the doctor blades 10, 14, with a tendency to fluidic instability, are avoided.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A device for metering and equalizing an ink layer on a surface of a printing machine inking unit applicator roller, said surface additionally being wetted with a dampening medium layer on said ink layer, said device comprising:

at least two doctor blades arranged at a short distance one behind an other as a front doctor blade and a rear doctor blade in a direction of rotation of said roller and which doctor blades rest under pressure against said surface, said front doctor blade having a blade edge radius such that substantially only said dampening medium layer can be wiped off from said surface leaving said ink layer remaining on said surface, said rear doctor blade having a comparatively smaller blade edge radius than said front doctor blade such that at least part of said remaining ink layer can be wiped off said surface.

2. The device according to claim 1, further comprising a chamber for receiving ink wiped off by said rear doctor blade, said wiped off ink generating an excess pressure in said chamber for effecting a discharge of ink from said chamber through at least one chamber orifice, said chamber being delimited in a circumferential direction of said roller by the front doctor blade and the rear doctor blade, in a radial direction of the roller by a chamber bottom and the roller surface, and in an axial direction of the roller by two side walls.

3. The device according to claim 2, wherein said chamber bottom includes passage bores therein, and further comprising an ink pressure source, said pressure source being connected to said chamber through said passage bores for producing a residual ink layer on the roller of specific thickness as a function of a pressure prevailing in said chamber.

4. The device according to claim 3, further comprising a duct extending parallel with and at a radial distance from said chamber, said duct forming a portion of an ink circuit in which pressurized ink can circulate, said passage bores communicating said duct constantly with said chamber.

5. The device according to claim 4, further comprising a throttle located downstream of said duct in a direction of flow in said ink circuit, said throttle having an adjustable cross section for controlling and regulating a pressure prevailing in said duct.

6. The device according to claim 5, wherein said duct is connected on a duct inlet side to a forward run of said ink circuit, and on a duct outlet side to an ink circuit return run, the adjustable throttle being located in said return run.

7. The device according to claim 1, wherein the front doctor blade has a blade edge radius of about 2 mm to about 10 mm, and the rear doctor blade a radius of about 0.1 mm to about 0.8 mm.

8. The device according to claim 1, wherein at least one of the front doctor and rear doctor blades is provided with one of an ink-repelling coating, and a combination of an ink-repelling and an ink-friendly coating.

9. The device according to claim 1, wherein each of said front doctor and rear doctor blades is provided with one of an ink-repelling coating, and a combination of an ink-repelling and an ink-friendly coating.

10. The device according to claim 1, wherein the device has a shorter length than a length of said roller, said device being moveable relative to said roller in traversing, oscillating and swinging movements running parallel to an axis of said roller.

11. The device according to claim 1, further comprising at least one spreading doctor blade located downstream of said front and rear doctor blades for smoothing a residual ink layer remaining on said roller surface, said spreading doctor blade in a state in which it is thrown onto said roller being moveable relative to said rollers in traversing, oscillating and swinging movements.

* * * * *